US006195942B1

(12) United States Patent
Sasaki et al.

(10) Patent No.: US 6,195,942 B1
(45) Date of Patent: Mar. 6, 2001

(54) REFRIGERATOR DOOR

(75) Inventors: Masatoshi Sasaki, Kyoto; Tadao Uno, Oumihachiman; Kouji Yamamoto, Kusatsu; Minoru Kobayashi, Otsu; Yoshika Katoh, Koga-gun, all of (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/297,345

(22) PCT Filed: Oct. 28, 1997

(86) PCT No.: PCT/JP97/03912

§ 371 Date: Jun. 29, 1999

§ 102(e) Date: Jun. 29, 1999

(87) PCT Pub. No.: WO98/19119

PCT Pub. Date: May 7, 1998

(30) Foreign Application Priority Data

Oct. 30, 1996 (JP) ..... 8-287857

(51) Int. Cl.[7] ..... E06B 7/16

(52) U.S. Cl. ..... 49/489.1; 49/478.1

(58) Field of Search ..... 49/475.1, 489.1, 49/495.1, 498.1, 478.1

(56) References Cited

U.S. PATENT DOCUMENTS

| | | | | |
|---|---|---|---|---|
| 3,763,595 | | 10/1973 | Sudyk . | |
| 4,617,759 | * | 10/1986 | Pasqualini et al. | 49/489.1 X |
| 5,060,358 | | 10/1991 | Haas et al. . | |
| 5,193,310 | * | 3/1993 | Kiel | 49/478.1 X |
| 5,257,791 | * | 11/1993 | Cittadini et al. | 49/490.1 X |
| 5,533,311 | | 7/1996 | Tirrell et al. . | |
| 5,606,828 | * | 3/1997 | Hall et al. | 49/478.1 X |
| 5,908,228 | * | 6/1999 | Lee | 49/478.1 X |

FOREIGN PATENT DOCUMENTS

| | | |
|---|---|---|
| 1509238 | 6/1972 | (DE) . |
| 85 17 330 | 8/1985 | (DE) . |
| 0 599 161 | 6/1994 | (EP) . |
| 1128627 | 9/1968 | (GB) . |

OTHER PUBLICATIONS

Japanese Utility Model Publication for Opposition No. 58,25258, 10 pages, Aug. 1956.
International Search Report dated Feb. 25, 1998 for PCT/JP97/03912.

* cited by examiner

*Primary Examiner*—Jerry Redman
(74) *Attorney, Agent, or Firm*—Ratner & Prestia

(57) ABSTRACT

A refrigerator door (17) includes an outer plate (6); an inner plate (7); a heat-insulating element (18) filling a gap between the outer plate (6) and the inner plate (7); and a gasket (21) provided between an outer housing (2) of a refrigerator main body (1) and a surface of the refrigerator door (17) facing the outer housing (2). The gasket (21) includes a housing engaging portion for sealing a gap between the outer housing (2) of the refrigerator main body (1) and the surface of the refrigerator door (17) facing the outer housing (2) and an anchor (23) for securing the gasket (21) in a groove (22) formed in the refrigerator door (17). The anchor (23) has a pair of fins (24), the fins of the pair projecting in opposite directions from each other, and is secured in the groove (22) by contact of the pair of fins (24) to inner walls of the groove (21) facing each other.

6 Claims, 3 Drawing Sheets

REFRIGERATOR DOOR

This application is a U.S. National Phase application of PCT International Application PCT/JP97/03912.

TECHNICAL FIELD

The present invention relates to a refrigerator door, and in particular to a mechanism for sealing the gap between a refrigerator main body and the door so as to thermally insulate the refrigerator main body from the outside.

BACKGROUND ART

A conventional refrigerator door described in, for example, Japanese Utility Model Publication for Opposition No. 58-25258, will be described with reference to FIG. 3. FIG. 3 is a cross-sectional view of an important part of the conventional refrigerator door.

As shown in FIG. 3, a refrigerator includes a refrigerator main body 1 and a door 5. The refrigerator main body 1 includes an outer housing 2, an inner housing 3, and a heat-insulating element 4 filling a space between the outer housing 2 and the inner housing 3. The door 5 includes an outer plate 6, an inner plate 7 and a door main body 18 formed of a heat-insulating foam 8 filling a space between the outer plate 6 and the inner plate 7. The door 5, which opens and closes, covers a front opening of the refrigerator main body 1. A gasket 9 is provided for filling the gap between the refrigerator main body 1 and the door 5 so as to thermally insulate the refrigerator main body 1 from the outside. The gasket 9 includes an outer engaging portion 12 having a concave portion 11. A top end of the outer engaging portion 12 is in contact with a bottom face of a magnet bag 10 containing a magnet therein. The gasket 9 further includes a two-layer heat-insulating air section 13 located closer to the interior of the door 5 than the outer engaging portion 12 and also includes an inner engaging portion 14. The inner engaging portion 14 is longer than the outer engaging portion 12. A support 16 is provided for facilitating insertion of the gasket 9 into a sachet groove 15 formed in the door 5 and also for alleviating the impact of the door 5 on the refrigerator main body 1 generated when the door 5 is closed.

Since the above-described refrigerator door has only one support 16, it is difficult to insert the gasket 9 into the sachet groove 15 because the gasket 9 is deformed when it is compressed. Moreover, when the sachet groove 15 is formed by vacuum molding, the size of the sachet groove 15 is non-uniform along the track direction of the groove 15. As a result, the gasket 9 may come out of the sachet groove 15 by opening and closing the door 5.

DISCLOSURE OF THE INVENTION

A refrigerator door according to the present invention includes an outer plate; an inner plate; a heat-insulating element filling a gap between the outer plate and the inner plate; and a gasket provided between an outer housing of a refrigerator main body and a surface of the refrigerator door facing the outer housing. The gasket includes a housing engaging portion for sealing a gap between the outer housing of the refrigerator main body and the surface of the refrigerator door facing the outer housing and an anchor for securing the gasket in a groove formed in the door. The anchor has a pair of fins, the fins of the pair projecting in opposite directions from each other, and is secured in the groove by contact of the pair of fins to inner walls of the groove facing each other.

In one embodiment of the invention, the anchor includes two heat-insulating layers of substantially equal size sandwiching a support extending in a depth direction of the groove.

In one embodiment of the invention, the support includes a projection projecting toward the housing engaging portion.

In one embodiment of the invention, the housing engaging portion includes a magnet bag containing a magnet therein, an outer engaging portion and an inner engaging portion. The magnet bag retains the magnet so that the center of gravity of the magnet is located offset from the center of the groove in the outside direction. The outer engaging portion includes a first wall extending from an outer side face of the magnet bag to an outer end of the anchor, and a distance between the first wall and a bottom face of the magnet is less toward the inner direction of the gasket than toward the outer direction of the gasket. The inner engaging portion includes a second wall extending from an inner end of the bottom face of the magnet bag to an inner end of the anchor.

In one embodiment of the invention, the gasket further includes a wing section located between the anchor and the housing engaging portion. The wing extends outward from a side end of the anchor adjacent to the housing engaging portion and adheres to a top side of the groove.

Thus, the invention described herein makes possible the advantages of providing a refrigerator door for facilitating the insertion of a gasket into a groove in the door and retaining the gasket in the groove with a sufficient force.

BEST MODE FOR CARRYING OUT THE INVENTION

Figure 1:
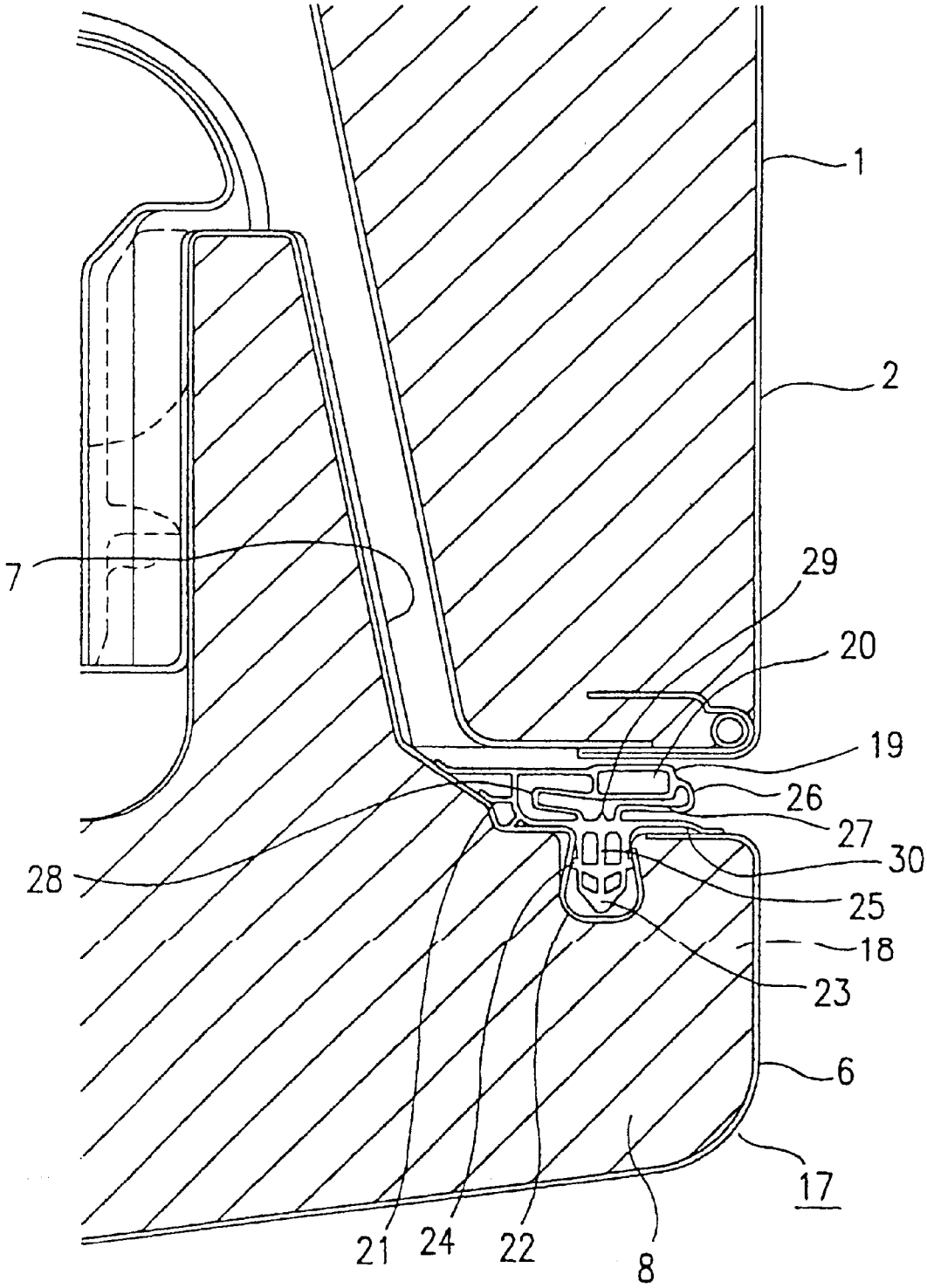
FIG. 1 is a cross-sectional view of an important part of a refrigerator door according to the present invention when being closed.

Hereinafter, the present invention will be described by way of an illustrative example with reference to FIGS. 1 and 2. Identical elements previously discussed with respect to FIG. 3 will bear identical reference numerals therewith and the descriptions thereof will be omitted.

Figure 2:
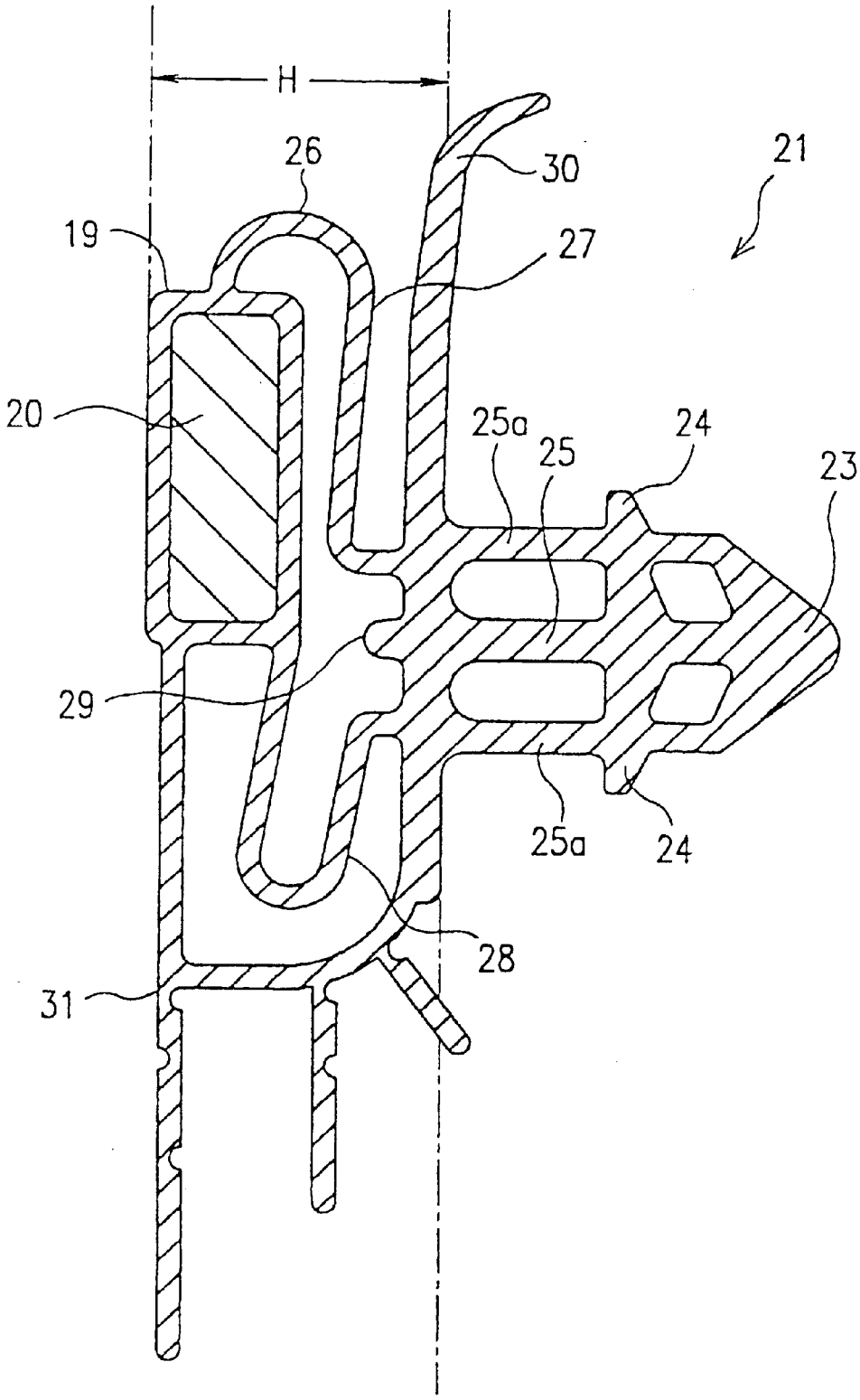
FIG. 2 is an enlarged cross-sectional view of a gasket of the refrigerator door shown in FIG. 1.

As described above, FIG. 1 is a cross-sectional view of an important part of a refrigerator door according to the present invention when being closed, and FIG. 2 is an enlarged cross-sectional view of a gasket of the refrigerator door shown in FIG. 1.

As shown in FIGS. 1 and 2, a refrigerator includes a refrigerator main body 1 and a door 17. The refrigerator main body 1 includes an outer housing 2. The door 17 includes an outer plate 6, an inner plate 7, a door main body 18 formed of a heat-insulating foam 8 (heat-insulating element) filling a space between the outer plate 6 and the inner plate 7, and a gasket 21. The gasket 21 is provided for filling the gap between the outer housing 2 of the refrigerator main body 1 and the door 17 for thermally insulate the refrigerator main body 1 from the outside. The gasket 21 fills the gap by causing a magnet 20 contained in a magnet bag 19 to adhere to the outer housing 2. The outer plate 6 of the door 17 has a groove 22 formed integrally therewith, into which the gasket 21 is insertable. The gasket 21 includes an anchor 23, and a wing 30 projecting outward from a base part of the anchor 23 and adhering to the top side of the groove 22 at least partially. The anchor 23 has a pair of fins 24 projecting in opposite directions from each other which are perpendicular to the depth direction of the groove 22. In this example, the fins 24 are provided at middle positions in the height direction of the anchor 23.

Since the anchor 23 of the gasket 21 does not have a fin at a tip thereof, the gasket 21 can be easily inserted into the groove 22 as far as the fins 24. Accordingly, the anchor 23 stands firmly in the groove 22 to facilitate the insertion of the rest of the gasket 21.

Although the groove 22 which is formed by vacuum molding cannot have a uniform size (width) through the entirety of the track direction thereof, the gasket 21 does not come out of the groove 22 since the fins 24 adhere to two walls of the groove 22 facing each other to secure the gasket 21 in the groove 22.

The anchor 23 further includes a support 25 extending the entire length, in the height direction thereof, of the middle part of the anchor 23. The support 25 gives firmness and strength to the anchor 23, which facilitates the insertion of the gasket 21 into the groove 22.

Since a heat-insulating space in the anchor 23 is divided into a plurality of sections by the support 25, heat conduction through the groove 22 is decreased. Thus, the heat-insulating effect is improved, resulting in less power consumption.

The gasket 21 also includes a housing engaging portion. The housing engaging portion includes the magnet bag 19 containing the magnet 20, an outer engaging portion 26, and an inner engaging portion 28. The magnet bag 19 retains the magnet 20 so that the center of gravity of the magnet 20 is located offset from the center of the groove 22 in the outside direction. The outer engaging portion 26 includes a first wall 27 extending from an outer side face of the magnet bag 19 to an outer end of the base part of the anchor 23. The first wall 27 is inclined; i.e., the distance between the first wall 27 of the outer engaging portion 26 and a bottom face of the magnet bag 19 is less toward the inner direction of the gasket 21 than toward the outer direction of the gasket 21. Thus, the height H is reduced. The inner engaging portion 28 includes a second wall extending from an inner end of the bottom face of the magnet bag 19 to an inner end of the base part of the anchor 23.

Owing to such a structure, the gap between the refrigerator main body 1 and the door 17 is reduced, thus decreasing heat conduction through the groove 22. Thus, the heat-insulating effect is improved, resulting in less power consumption.

Figure 3:
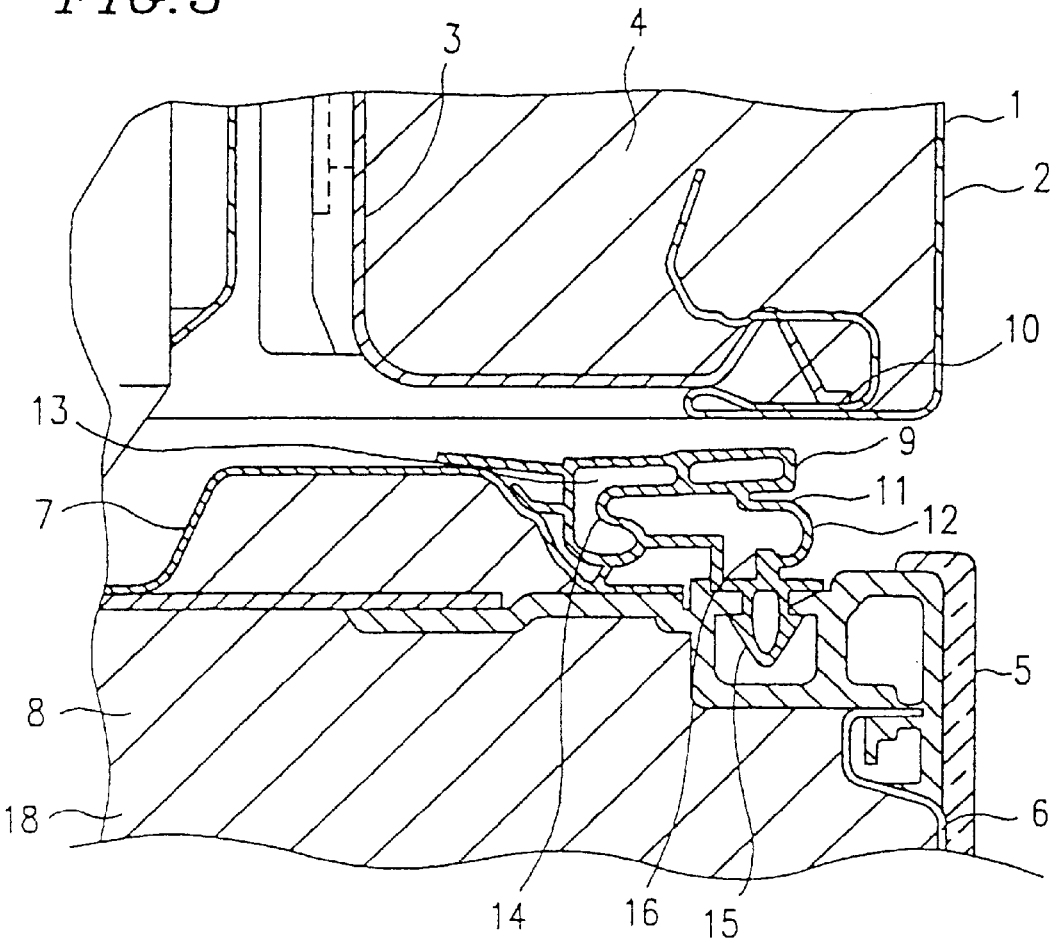
PRIOR ART FIG. 3
FIG. 3 is a cross-sectional view of an important part of a conventional refrigerator door.

The outer engaging portion 26 does not have the concave portion 11 shown in FIG. 3 (conventional refrigerator door). Furthermore, the magnet bag 19 adheres to the refrigerator main body 1 horizontally with respect thereto or in such a manner as to reduce the gap between the door 17 and the refrigerator main body 1. For these reasons, liquids and dust are prevented from entering the interior of the refrigerator, thus improving hygiene.

The outer engaging portion 26 and the inner engaging portion 28 are respectively connected to two ends of the base part of the anchor 23. Accordingly, when the gasket 21 is inserted into the groove 22, a force from the inner side of the refrigerator, as well as a force from the outer side of the refrigerator, is conveyed to the anchor 23. Thus, the gasket 21 receives the force uniformly, thereby facilitating the insertion of the gasket 21 to the groove 22.

Moreover, the outer engaging portion 26 and the inner engaging portion 28 are connected to respective two side supports 25*a* interposing the support 25. Thus, the anchor 23 is further strengthened so as to facilitate the insertion of the gasket 21 into the groove 22.

The support 25 of the gasket 21 has a projection 29 projecting from the base part of the anchor 23 toward the housing engaging portion. When the gasket 21 is inserted into the groove 22, the projection 29 causes the magnet bag 19 to be pushed down uniformly in the horizontal-direction and also conveys a force to the center of the anchor 23. Accordingly, the gasket 21 is prevented from being deformed, thus facilitating the insertion of the gasket 21 into the groove 22.

An inside portion 31 of the gasket 21 is provided for further improving the sealing state between the outer housing 2 of the refrigerator main body 1 and the surface of the door 17 facing the outer housing 2. The structure and the function of the inside portion 31 is the same as those of the conventional refrigerator door and will not be described herein.

INDUSTRIAL APPLICABILITY

In a refrigerator door according to the present invention, the anchor of the gasket has a pair of fins projecting in opposite directions from each other which are perpendicular to the depth direction of a groove formed in the door main body. Accordingly, the insertion of the gasket into the groove in the door main body is facilitated and the door retains the gasket with a sufficient-force.

In the case where the anchor includes a support extending the entire length, in the height direction thereof, of the middle part of the anchor, the insertion of the gasket into the groove is further facilitated. By providing a heat-insulating layer, heat conduction from the outside is decreased, thus reducing the power consumption.

In the case where the outer engaging portion includes a first wall extending from an outer side face of the magnet bag to an outer end of the base part of the anchor, the distance between the first wall of the outer engaging portion and a bottom face of the magnet bag is less toward the inner direction of the gasket than toward the outer direction of the gasket, and the inner engaging portion includes a second wall extending from an inner end of the bottom face of the magnet bag to an inner end of the base part of the anchor, the height of the gasket is reduced. Accordingly, the gap between the refrigerator main body and a surface of the door facing the refrigerator main body is reduced. Thus, heat conduction is decreased and the power consumption is reduced. Furthermore, liquids and dust are prevented from entering the interior of the refrigerator, thus improving hygiene. When the gasket is inserted into the groove, a force from the inner side of the refrigerator, as well as a force from the outer side of the refrigerator, is conveyed to the anchor. Thus, the gasket receives the force uniformly, thereby facilitating the insertion of the gasket to the groove in the door.

In the case where the support of the gasket has a projection projecting toward the housing engaging portion, the insertion of the gasket into the door is further facilitated.

What is claimed is:

1. A refrigerator door, comprising:

an outer plate;

an inner plate;

a heat-insulating element filling a gap between the outer plate and the inner plate; and a gasket provided between an outer housing of a refrigerator main body and a surface of the refrigerator door facing the outer housing, wherein the gasket includes a housing engaging portion for sealing a gap between the outer housing of the refrigerator main body and the surface of the refrigerator door facing the outer housing, and an anchor for securing the gasket in a groove formed in the refrigerator door, the anchor comprises a pair of fins, a support extending in a depth direction of the groove, and two heat-insulating layers of substantially equal size sandwiching the support, and the pair of fins are located at middle positions in a height direction of the anchor and project in opposite directions from each other, such that the anchor is firmly secured in the groove by contact of the pair of fins to inner walls of the groove which face each other during insertion of the remaining portions of the gasket.

2. A refrigerator door according to claim 1, wherein the support includes a projection projecting toward the housing engaging portion.

3. A refrigerator door according to claim 1, wherein the housing engaging portion comprises a magnet bag containing a magnet therein, an outer engaging portion and an inner engaging portion, the magnet bag retains the magnet so that a centre of gravity of the magnet is located offset from a centre of the groove in an outside direction, the outer engaging portion comprises a first wall extending from an outer side face of the magnet bag to an outer end of the anchor, and a distance between the first wall and a bottom face of the magnet is less toward an inner direction of the gasket than toward an outer direction of the gasket, and the inner engaging portion comprises a second wall extending from an inner end of a bottom face of the magnet bag to an inner end of the anchor.

4. A refrigerator, comprising:

a main body; and a door having:

(a) an outer plate, (b) an inner plate spaced from the outer plate, (c) a heat-insulating element in the space between the outer plate and the inner plate, (d) a groove in a surface of the door facing the main body and extending vertically of the door, and (e) a gasket extending vertically of the door between the door and the main body and having:

(1) a housing engaging portion for sealing a gap between the main body and the surface of the door facing the main body, and (2) an anchor fitted in the groove to secure the gasket in the groove and having:

(i) a support extending into the groove, (ii) a pair of fins located at the middle positions in a height direction of the anchor and extending in opposite directions from the support into contact with oppositely disposed walls of the groove, and (iii) two heat-insulating layers of substantially equal size sandwiching the support.

5. A refrigerator according to claim 4, further including a magnet bag having a magnet in the housing engaging portion of the gasket with the center of gravity of the magnet offset from the center of the groove.

6. A refrigerator according to claim 5, further including a magnet bag having a magnet in the housing engaging portion of the gasket with the center of gravity of the magnet offset from the center of the groove.

* * * * *

UNITED STATES PATENT AND TRADEMARK OFFICE

CERTIFICATE OF CORRECTION

PATENT NO. : 6,195,942 B1
DATED : March 6, 2001
INVENTOR(S) : Masatoshi Sasaki et al.

It is certified that error appears in the above-identified patent and that said Letters Patent is hereby corrected as shown below:

Column 6,
Line 31, claim 6 should be deleted, and instead insert the following:

6. A refrigerator door according to claim 1, wherein the gasket further comprises a wing section located between the anchor and the housing engaging portion, and the wing extends outward from a side end of the anchor adjacent to the housing engaging portion and at least partially adheres to a top side of the groove.

Signed and Sealed this

Twenty-first Day of September, 2004

JON W. DUDAS
*Director of the United States Patent and Trademark Office*